United States Patent [19]

McBride, Jr.

[11] 4,403,754

[45] Sep. 13, 1983

[54] YARN TENSION WITH HORIZONTAL ROLLER

[76] Inventor: Edward J. McBride, Jr., P.O. Box 311, Moorestown, N.J. 08052

[21] Appl. No.: 189,606

[22] Filed: Sep. 22, 1980

[51] Int. Cl.[3] ..... B65H 59/24

[52] U.S. Cl. ..... 242/151; 242/157 R

[58] Field of Search ..... 242/151, 152, 152.1, 242/147 R, 149, 153, 154, 157 R; 226/195

[56] References Cited

U.S. PATENT DOCUMENTS

| | | | |
|---|---|---|---|
| 1,040,185 | 10/1912 | Gerstberger | 242/152.1 |
| 1,167,636 | 1/1916 | Eastwood | 242/152.1 |
| 1,202,105 | 10/1916 | Sawtell | 242/151 |
| 1,211,862 | 1/1917 | Lister | 242/152.1 |
| 1,306,148 | 6/1919 | Houghton | 242/153 |
| 1,372,557 | 3/1921 | Sawtell | 242/152.1 |
| 1,402,894 | 1/1922 | Sawtell | 242/152.1 |
| 1,432,399 | 10/1922 | Land | 242/152.1 |
| 1,825,626 | 9/1931 | Bock | 242/151 |
| 2,464,664 | 3/1949 | Amon | 242/157 R |
| 3,753,535 | 8/1973 | Zollinger | 242/152.1 |
| 4,019,701 | 4/1977 | McCullough | 242/152.1 |
| 4,094,477 | 6/1978 | McBride, Jr. | 242/152.1 |
| 4,095,757 | 6/1978 | Singer | 242/151 |
| 4,165,056 | 8/1979 | Singer | 242/151 |

FOREIGN PATENT DOCUMENTS

| | | | |
|---|---|---|---|
| 382322 | 10/1923 | Fed. Rep. of Germany | 242/151 |
| 126805 | 5/1919 | United Kingdom | 242/151 |

OTHER PUBLICATIONS

Qualitex, Inc. Four-Page Brochure Entitled "Qualitex".

Qualitex, Inc. Two-Page Brochure Entitled "Qualitex".

*Primary Examiner*—Stanley N. Gilreath

*Attorney, Agent, or Firm*—Weiser, Stapler & Spivak

[57] ABSTRACT

A yarn tension device is disclosed which includes a generally hollow, cylindrical body having an open top and an interior channel of sufficient size to contain one or more tensioning balls. The body terminates downwardly in inwardly converging bottom walls within which are mounted a pair of diametrically opposed ceramic eyelets for yarn inlet and yarn outlet. A flanged roller is horizontally positioned at the bottom of the body in transverse alignment to a plane through the eyelets to apply tension to yarn passing through the eyelets. The body is formed with parallel, planar walls adjacent to the roller flanges to maintain the position and orientation of the roller during yarn tensioning.

27 Claims, 6 Drawing Figures

YARN TENSION WITH HORIZONTAL ROLLER

BACKGROUND OF THE INVENTION

The present invention relates generally to yarn tensioning devices, and more particularly, is directed to a yarn tension device suitable for use with yarn generally disposed in a horizontal alignment.

In the various industries which employ yarns to fabricate the finished product, such as in weaving and knitting, it is the usual practice to tension such yarns prior to entering the weaving or knitting machines by exerting a braking action on the yarns to control tension on the yarn so that it may be readily processed by the machine in a uniform manner. Most prior art yarn tensioning devices were designed to treat vertical yarns inasmuch as a great majority of machines utilized in the textile industry were designed for operation with yarns traveling in a substantially vertical path. U.S. Pat. No. 3,753,535 is exemplary of one prior art ball type tensioning device suitable for use with vertical yarns. Such devices function well with yarns in vertical orientation, but are completely unsuitable for use with machines wherein the yarns are run in a generally horizontal orientation. The present applicant and other prior workers in the art have designed yarn tensioning devices for use with horizontal yarns and U.S. Pat. Nos. 4,094,477, 1,040,185, 1,372,557, 1,402,894, 1,211,862, 1,490,512, 1,167,636 and 3,383,072 are exemplary of known horizontal type yarn tension devices. The present invention seeks to provide improved performance in a relatively uncomplicated construction over all known prior horizontal yarn tension devices.

SUMMARY OF THE INVENTION

The present invention relates generally to apparatus designed to compensate for tension variations in yarns as they are advanced into various yarn processing machines, and more particularly, is directed to a roller type yarn tension device suitable for use with horizontally advancing yarns.

The device of the present invention incorporates a generally hollow, cylindrical vertical body which defines a vertical interior channel. The channel terminates upwardly in an open top to facilitate inserting or changing yarn tensioning devices within the channel. The hollow channel terminates downwardly in angularly inwardly inclined bottom walls which include openings to receive a pair of diametrically opposed ceramic eyelets therein for directing yarn through the tension device. The eyelets include yarn openings which communicate with the interior channel for yarn passage therethrough. Preferably, the eyelet openings are inclined angularly downwardly to provide a restricted, generally horizontal yarn path through the tension device. In the preferred embodiment, ceramic eyelets are loosely mounted within the openings in the bottom walls to permit limited movement of the ceramic eyelets relative to the body of the yarn tension device.

The bottom of the tension device body is formed with a pair of spaced, generally vertical planar or side walls oriented through ninety degrees from a plane drawn through the axes of the ceramic eyelets to define a bottom channel area having a pair of spaced vertical side walls rotated through ninety degrees from a pair of angularly inwardly converging walls.

A flanged roller assembly comprising a spool-shaped ceramic roller including end flanges is positioned within the bottom channel space with the end flanges adjacent to the vertical bottom sidewalls in a loose fit to permit rotation of the roller as the yarn is fed through the tension device. Use of a rotating, flanged roller in a ceramic seat permits full contact of the roller body with the moving yarn to thereby impart a constant, even tension to the yarn. The flanged roller is upwardly unrestricted in movement within the channel to allow knots or slubs to temporarily raise the roller off of its ceramic seats without binding or jamming in any manner. The flanged roller also permits any twists in the yarn to pass through the tensioning device rather than allowing the twists to be backed up or peeled back as may occur when utilizing certain types of static tensioning devices. The body of the flanged roller assembly includes an axial bore through the spool within which is cemented or pressed a steel rod of length substantially equal to the roller body. The steel rod provides additional weight to the assembly for tensioning purposes and additionally, facilitates insertion and withdrawal of the flanged roller assembly within the channel by employing a known type of magnetic tool.

The flanges of the roller assembly serve to stabilize the assembly on the seat and to provide more mass to prevent undesirable vibrations when running yarns at high speeds or when employing yarns with uneven surfaces. The flanges prevent the roller from sliding off the seat under all conditions of operation without substantially restricting freedom of movement of the roller. The flanged roller assembly allows the passage of knots and other imperfections by rising off of the seats sufficiently to pass such imperfections. Under such conditions, tension levels will be temporarily lowered to compensate for the adverse effect of the imperfection. However, the desired tension levels will be immediately restored when the roller drops back onto the seats after the passing of the knot.

One or more tensioning weights, such as balls can be positioned within the vertical channel above the flanged roller to provide additional tensioning when so desired. Sufficient vertical freedom is provided to allow the roller and any additional tension elements riding on top of the roller to move upwardly so that a threading instrument may pass between the roller and the seats when introducing the yarn to the tension control unit.

The flanged roller assembly of the present invention provides superior tension control over prior art horizontal units using spherical tensioning elements as the primary means of tension. The cylindrical barrel of the flanged roller assembly assures that the roller and any accompanying additional weights will rotate at all times of yarn movement so that the yarn is not dragged past a stationary element as may often occur with prior art horizontal ball type tension devices. The constant rotation assures even tension levels, undamaged yarn and a cleaner operation due to less friction on the yarn by the element that always rotates with the yarn. Various polishes may be applied to the flanged roller assembly in the yarn contact area to accommodate special types of yarn when necessary. Usually, a dull or matte finish has been found to be satisfactory for most yarn applications.

It is therefore an object of the present invention to provide an improved yarn tension device with horizontal roller of the type set forth.

It is another object of the present invention to provide a novel yarn tension with horizontal roller which comprises a generally hollow body defining a vertical, interior channel, the channel terminating downwardly in a pair of oppositely inclined, converging bottom walls, a ceramic eyelet respectively mounted in each of said converging bottom walls and a flanged roller seating upon portions of the eyelets for yarn tensioning, the roller having its longitudinal axis at right angles to a plane drawn through the centers of the respective eyelets.

It is another object of the present invention to provide a novel yarn tension with horizontal roller which comprises vertical channel means to retain tensioning devices therein, the vertical channel means terminating downwardly in a pair of converging, inwardly inclined bottom walls, eyelet means respectively mounted within openings in the converging bottom walls, a transverse roller means within the channel in position to seat upon portions of the eyelet means and vertical, planar, bottom walls adjacent the ends of the roller means to maintain the longitudinal position of the roller means within the bottom of the channel means.

It is another object of the present invention to provide a novel yarn tension with horizontal roller which inludes a body defining an interior, vertical channel, a pair of ceramic eyelets mounted in the bottom of the body and defining respective angularly inclined, seats within the body, a ceramic roller transversely positioned to roll upon the respective seats to tension a yarn and a rolling element positioned within the channel above and in contact with the roller to impart increased tension to a horizontal yarn as the yarn passes through the device.

It is another object of the present invention to provide a novel yarn tension with horizontal roller which comprises a body defining a vertical, generally cylindrical channel, the channel terminating downward in a pair of converging bottom walls and a pair of spaced, vertical, planar walls, a grommet loosely retained in each of said converging walls to define inclined seats and a roller positioned in the channel intermediate the planar walls and adapted to roll upon the seats as yarn travels through the grommets for yarn tensioning purposes.

It is another object of the present invention to provide a novel yarn tension with horizontal roller that is inexpensive in manufacture, rugged in construction and trouble free when in use.

Other objects and a fuller understanding of the invention will be had by referring to the following description and claims of a preferred embodiment thereof taken in conjunction with the accompanying drawings wherein like reference characters refer to similar parts throughout the several views and in which:

DESCRIPTION OF THE PREFERRED EMBODIMENT OF THE INVENTION

Figure 1:
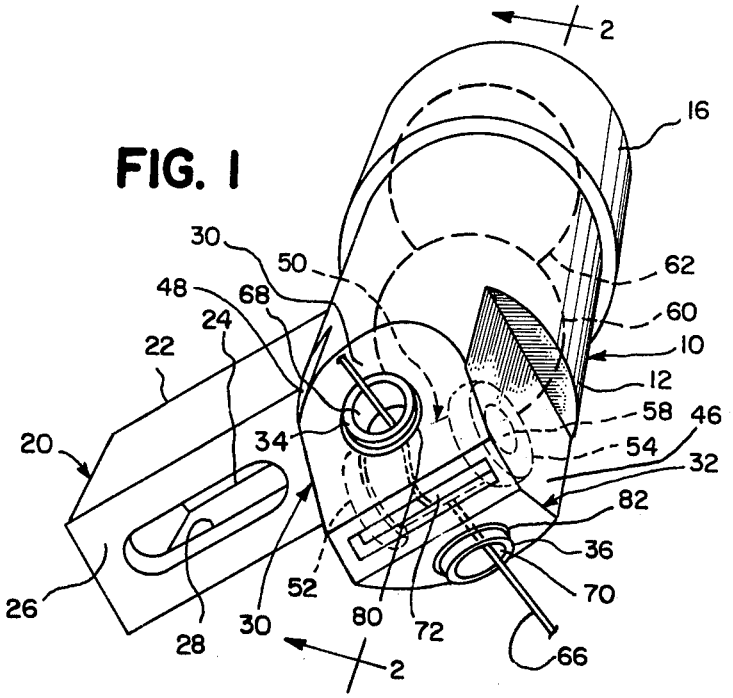
FIG. 1 is a perspective view of the yarn tension with horizontal roller of the present invention, with interior components illustrated in phantom lines for purposes of association.

Although specific terms are used in the following description for the sake of clarity, these terms are intended to refer only to the particular structure of the invention selected for illustration in the drawings and are not intended to define or limit the scope of the invention.

Figure 2:
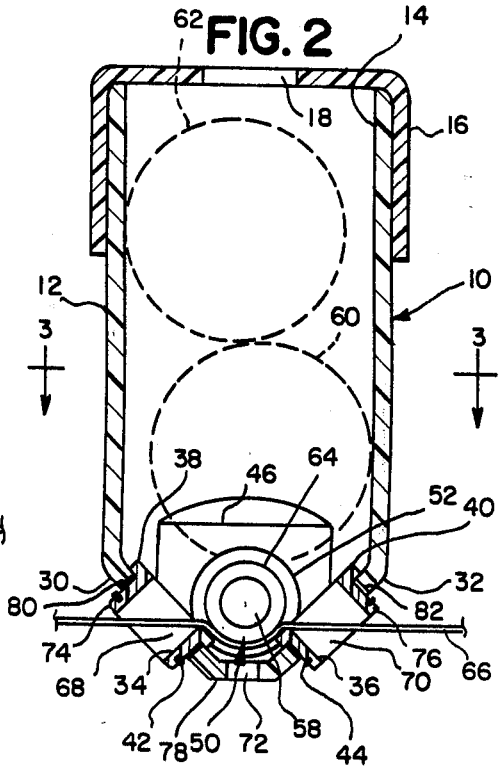
FIG. 2 is a cross sectional view taken along line 2—2 on FIG. 1, looking in the direction of the arrows.

Referring now to the drawings, there is illustrated in FIGS. 1 and 2, a horizontal roller tension device 10 comprising generally a plastic body 12 which is molded or otherwise formed to define a hollow, interior, substantially vertical channel 14. The channel 14 terminates upwardly in an open upper end or top which may be partially enclosed by a separate end cap 16. Preferably, the top of the end cap 16 is provided with a concentric or axial opening 18 to provide easy access and visability into the channel 14.

Figure 3:
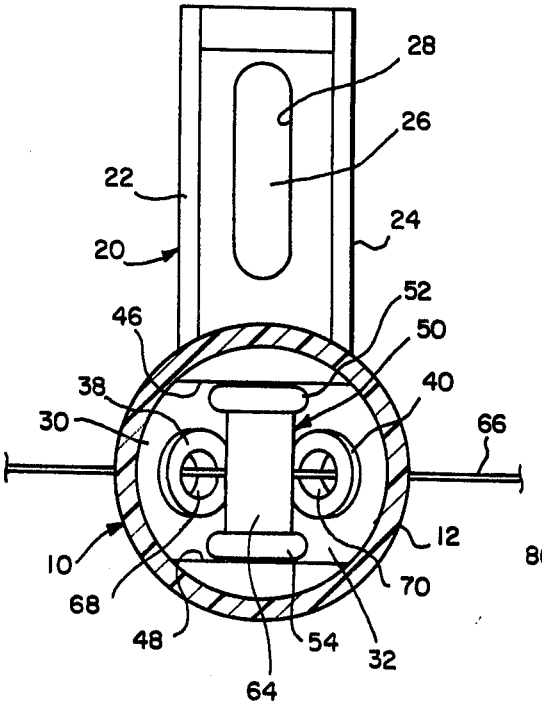
FIG. 3 is a cross sectional view taken along line 3—3 on FIG. 2, looking the direction of the arrows.

As best seen in FIGS. 1 and 3, generally horizontal, integral mounting bracket 20 extends radially outwardly from the body 12 for securing the roller tension device 10 to a textile processing machine (not shown) such as a knitting machine or a weaving machine. In the preferred embodiment, the mounting bracket 20 comprises a horizontally disposed web 26 and a pair of spaced, vertical, elongated, strengthening legs 22, 24 extending at right angles upwardly or downwardly therefrom. As illustrated, the web 26 is molded, machined, or otherwise treated to include an elongated slot 28 for mounting purposes. If desired, either or both of the vertical legs 22, 24 could similarly be provided with elongated slots (not shown) for tension device mounting.

The yarn tension body 12 is generally hollow cylindrical in configuration and the channel 14 is downwardly defined by a pair of angularly inclined, converging bottom walls 30, 32 which are bottomly joined at the body bottom 78. Preferably, the body bottom 78 is provided with an elongated opening or slot 72 which serves to continuously release dust and lint from within the interior channel 14 and to facilitate bottom access into the channel 14 for yarn servicing purposes.

As best seen in FIG. 2, a pair of similar, ceramic eyelets or grommets 34, 36 loosely fit within respective openings 80, 82 which are formed in the converging bottom walls 30, 32. As illustrated, each grommet 34, 36 is inwardly formed with a circular, interior flange 38, 40, which flanges serve as seats for the roller 50 for yarn tensioning as hereinafter more fully set forth. The grommet flanges 38, 40 are larger in diameter than the respective openings 80, 82 to thereby prevent grommet displacement through the openings after the grommets 34, 36 are properly seated during the assembly procedures.

Still referring to FIG. 2, it will be observed that the grommets 34, 36 include cylindrical bodies which respectively extend through the converging bottom walls 30, 32. Each grommet includes a peripheral groove 74, 76 of suitable size and configuration to retain a respective retaining ring 42, 44 therein. It is noteworthy that the retaining rings 42, 44 are larger in exterior diameter than the diameter of the bottom wall openings 80, 82. Accordingly, once the grommets 34, 36 are seated as illustrated in FIG. 2, and the retaining rings 42, 44 are properly positioned, then the grommets 34, 36 are free to move in a restricted manner within the respective openings 80, 82 but cannot be removed from association with the body 12 without first removing the retaining rings 42, 44. Thus, the grommets 34, 36 are free to flex in a limited manner within their respective openings 80, 82 to accommodate variations in yarns which may be the result of imperfections, tension differentials, pressure changes and the like.

Figure 5:
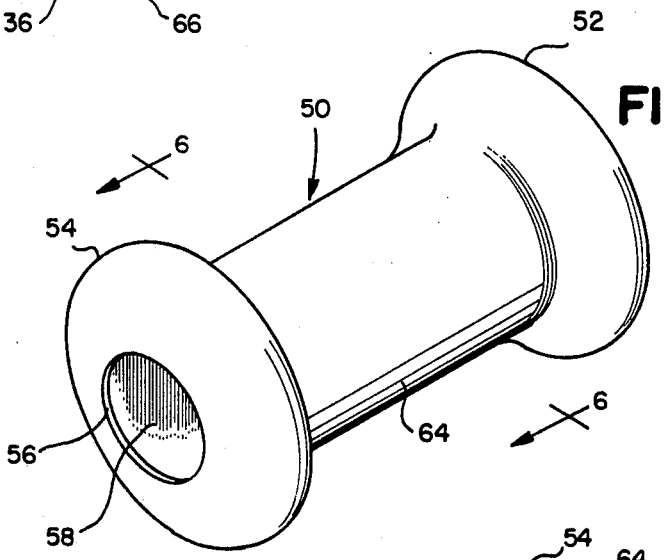
FIG. 5 is an enlarged, perspective view showing construction details of the flanged roller.
Figure 6:
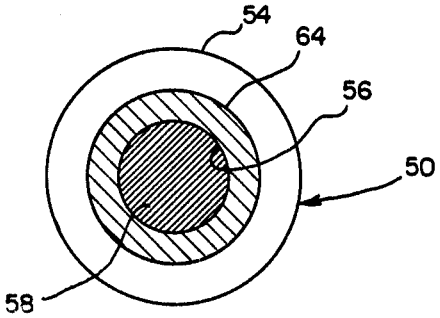
FIG. 6 is a cross sectional view taken along line 6—6 on FIG. 5, looking in the direction of the arrows.

Referring now to FIGS. 2 and 3, the roller 50 is illustrated in tensioning arrangement upon the respective flanges or seats 38, 40 of the grommets 34, 36 for yarn tensioning purposes therebetween. As illustrated in FIGS. 5 and 6, the roller 50 is fabricated to a generally spool-like configuration and includes a generally cylindrical body 64 and integral, circular end flanges 52, 54. The cylindrical body 64 is provided with a longitudinal axial bore 56 that extends completely longitudinally of the roller 50 from one end flange 52 through the other end flange 54. A rod 58 of steel or other magnetically attractive material is pressed or cemented to remain within the bore 56 and serves the dual purpose of providing additional weight for yarn tensioning as well as to provide a magnetically attractive core to facilitate placement of the roller 50 within the bottom of the interior channel 14 by utilizing a magnetic tool of conventional design. Preferably, the roller body 64 including the integral end flanges 52, 54 is fabricated of ceramic material, such as titanium dioxide or aluminum oxide ceramic material.

Figure 4:
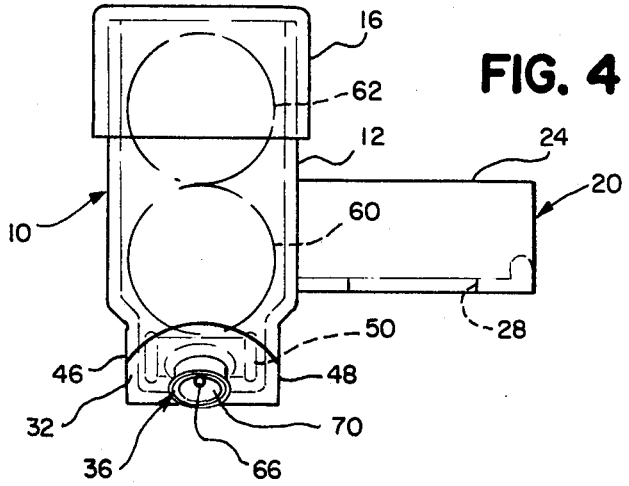
FIG. 4 is a side elevational view of the tension device.

As illustrated in FIGS. 3 and 4, the bottom of the body 12 is downwardly closed at right angles to the converging bottom walls 30, 32 with a spaced pair of planar, bottom vertical walls 46, 48. The planar bottom walls 46, 48 extend upwardly from the body bottom 78, a sufficient distance to receive and retain the spool or roller end flanges 52, 54 therebetween in a loose fitting arrangement. The flanges 52, 54 tend to spin in parallel, slightly spaced arrangement from their respective planar bottom walls 46, 48 and act to stabilize the roller body 64 upon the grommet seats 38, 40. The flanges 52, 54 prevent undesirable vibrations at the roller 50 even when running at very high speeds or with uneven yarn surfaces. The planar bottom walls 46, 48 in cooperation with the roller end flanges 52, 56 prevent the roller 50 from sliding off of the grommet seats in a manner without substantially restricting the freedom of movement of the roller both rotational when tensioning the yarn and vertical when rising to permit the passage of yarn imperfections.

In the preferred embodiment, as shown in FIGS. 1 and 2, one or more additional tensioning weights in the form of rotating balls 60, 62 may be applied in the vertical body channel 14 in a manner to rest directly upon the body 64 of the roller 50 to increase available tensioning forces when this is desirable. In the embodiment illustrated, the balls 60, 62 rest directly upon the roller body 64 and in turn are rotated as the roller 50 is rotated by passage of the yarn 66 therethrough. In the embodiment illustrated, the balls 60, 62 may be fabricated of polyethylene spheres which can be employed to provide the proper, desired weight at the grommet seats 38, 40 for tensioning by the roller 50. Additionally, polyethylene provides advantages in operation inherent from the physical characteristics of the material wherein lint, oil, dust and other impurities will not stick or cling to the polyethylene ball surface. Preferably, the outer peripheries of the polyethylene balls 60, 62 are ground after molding to remove mold flash to provide a desired texture to the surface to prevent slipping and to assure rotation of the balls as the roller 50 is rotated.

In use, a suitable magnetic tool (not shown) is employed to position the roller 50 upon the grommet flanges 38, 40 as shown in FIG. 2 and in transverse alignment with the flanges 52, 54 adjacent to and between the planar bottom walls 46, 48. A threading instrument of known construction (not shown) is then utilized to insert the yarn 66 through the grommet channels 68, 70 and beneath the cylindrical body 64 of the ceramic roller 50. It is noteworthy that the roller 50 and any additional tensioning elements 60, 62 which may be positioned within the channel 14 and are riding on top of the roller 50 are free to move upwardly within the channel 14 sufficiently to allow the yarn 66 to pass between the roller body 64 and the grommet seats 38, 40 when introducing the yarn to the tension control device 10.

The flanged roller 50 provides superior tension control to the yarn 66 when compared to other prior art type of tension control units which employ spherical tensioning elements as the primary means of tension. The cylindrical barrel or body 64 of the flanged roller 50 which comes in contact with the yarn insures that the roller and its accompanying weights 60, 62 rotate at all times so that the yarn is not forced past a stationary or stuck element as often occurs with ball type tension controls. The constant rotation of the rotating units 50, 60, 62 assures even tension levels, undamaged yarn and cleaner operation due to less friction on the yarn by the rotating element which thereby acts to reduce fiber and finish removal from the yarn.

As above set forth, the grommets or eyelets 34, 36 are loosely retained within the respective openings 80, 82 and have limited, adjusting movement within the openings between the respective flanges 38, 40 and the respective retaining rings 42, 44. When yarn 66 passes through the grommet channels 68, 70 to be tensioned by and to rotate the roller 50, the roller body 64 will seat upon portions of the grommet flanges 38, 40. Rotation of the roller 50 upon the grommets 34, 36 will cause the loosely held eyelets or grommets to move or rotate within their respective openings 80, 82, thereby distributing the wear on the flanges 38, 40. By employing loosely retained eyelets in the manner described, the horizontal roller tension 10 of the present invention can be made adaptable for use with a wide variety of yarn sizes without alteration. The grommets 34, 36 can swivel as may be necessary within their respective openings 80, 82 in a manner to absorb shocks and to provide an automatically adjustable seat for the roller 50 for both large and small yarns. The limited freedom of movement of the eyelets allows the grommets to conform to the roller surface to provide proper seats for yarn tensioning purposes, no matter what kind of yarn is being run. If the eyelets were cemented in place and not permitted to float within their respective openings, it is possible that with some yarns there could be a space between the roller body and the seat, a condition that could result in loss of tension or in reduced efficiency. In the case of the present invention, the free floating grommet mounting allows the grommets to move within their respective openings 80, 82 to conform to the roller surface for yarn tensioning as dictated by the yarn size.

Although the present invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A roller type yarn tension device comprising a hollow body defining a generally vertical interior channel, the body being downwardly formed to provide a pair of diametrically opposed, angularly oriented, converging, bottom walls, each bottom wall being provided with a grommet receiving opening; a grommet loosely retained in at least one said bottom wall opening, the grommet having a body defining an interior channel therethrough, the channel defining a yarn path through the tension device, the grommet being adapted to have limited movement within its respective opening, the grommet comprising means to retain the grommet within its associated opening; and a roller horizontally oriented within the interior body channel and positioned to roll over and seat upon a portion of the grommet to tension a yarn as it travels through the said yarn path.

2. The tension device of claim 1 wherein the said bottom walls are angularly inclined from the horizontal through an angle of about forty-five degrees.

3. The tension device of claim 1 wherein the grommet channel has a longitudinal axis, the channel axis being angularly inclined from the horizontal through an angle of about forty-five degrees.

4. The tension device of claim 1 wherein the means to retain the grommet comprises an integral, circular flange, the flange being greater in diameter than the associated bottom wall opening.

5. The tension device of claim 1 or claim 4 wherein the means to retain the grommet comprises a retaining ring and means to secure the retaining ring to the grommet body, the retaining ring being greater in diameter than the associated bottom wall opening.

6. The tension device of claim 1 and a second grommet loosely retained in the second said bottom wall opening, the first and second grommets being diametrically opposed and defining the yarn path as diametrical.

7. The tension device of claim 1 wherein the roller is ceramic, and is provided with a longitudinal, axial bore.

8. The tension device of claim 7 wherein the roller is provided with an axial core retained within the said bore.

9. The tension device of claim 8 wherein the core is fabricated of non-ceramic material.

10. The tension device of claim 8 or claim 9 wherein the core is comprised of magnetically attractive material.

11. The tension device of claim 1 wherein the roller is generally spool-shaped in configuration and comprises a cylindrical body, the body terminating endwardly in spaced end flanges.

12. The tension device of claim 11 wherein the cylindrical body is adapted to contact and seat upon the said grommet portion for yarn tensioning.

13. The tension device of claim 1 wherein the hollow body is downwardly formed to provide a pair of spaced, planar walls, the planar walls being contiguous with and interconnecting the said converging bottom walls.

14. The tension device of claim 13 wherein the planar walls are circularly offset from the converging bottom walls by ninety degrees.

15. The tension device of claim 14 wherein the planar walls are oriented to lie in respective vertical planes.

16. The tension device of claim 15 wherein the roller is generally spool-shaped in configuration and comprises a cylindrical body, the body terminating endwardly in spaced end flanges.

17. The tension device of claim 16 wherein each of the roller flanges is adapted to loosely abut one said planar wall.

18. The tension device of claim 17 wherein the roller is adapted for vertical movement within the vertical interior body channel in horizontal juxtaposition to the planar walls.

19. The tension device of claim 18 wherein the planar walls define a vertical track within which track the roller flanges are adapted to vertically move.

20. The tension device of claim 1 wherein the roller is adapted for vertical movement with the body vertical channel and means to retain the horizontal orientation of the roller in its vertically moved positions.

21. The tension device of claim 20 wherein the body is downwardly formed to provide a pair of spaced, planar walls, the planar walls being contiguous with and interconnecting the said converging bottom walls.

22. The tension device of claim 21 wherein the means to retain the horizontal orientation comprises a vertically disposed roller flange, the roller flange being positioned adjacent to a said planar wall and being adapted to move vertically with respect to the wall.

23. The tension device of claim 22 wherein the means to retain comprises a pair of spaced, vertically disposed flanges provided in the roller, each flange being positioned adjacent to one of said planar walls and being adapted for vertical sliding movement relative to the wall.

24. The tension device of claim 11 or claim 23 wherein the flanges are integral with the roller body.

25. The tension device of claim 11 or claim 23 wherein the flanges are integral with the roller body and wherein the roller is comprised of ceramic material.

26. A roller type yarn tension device comprising a roller and a hollow body defining a generally vertical interior channel, the body being downwardly formed to provide a pair of diametrically opposed, angularly inclined, converging, bottom walls, each bottom wall being provided with a grommet receiving opening;

a grommet loosely retained in each said bottom wall opening and being movable relative to the bottom wall, each grommet having a body defining an interior channel therethrough, the grommet channels defining a yarn path through the yarn tension device, the grommets being inwardly formed with interior flanges, the flanges being positioned respectively on a bottom wall and within the vertical channel in a position to be contacted by the roller, the grommets comprising means to retain the grommets within their respective associated openings; and the roller being horizontally oriented within the interior vertical channel and positioned to roll over and seat upon a portion of the grommet flanges to tension a yarn therebetween as the yarn travels through the said yarn path.

27. The roller type yarn tension device of claim 26 and a pair of spaced, vertical, planar walls, forming portions of the vertical channel, the planar walls being contiguous with and interconnecting the said converging bottom walls, the vertical wall being spaced apart sufficiently to retain the roller therebetween in a loose fitting arrangement and to define a vertical path of travel for the roller.

* * * * *